United States Patent [19]

Gitlin

[11] 4,131,190

[45] Dec. 26, 1978

[54] TAMPERPROOF COIN BOX CLOSURE

[76] Inventor: Harvey Gitlin, 2232 Bryn Mawr Ave., Philadelphia, Pa. 19131

[21] Appl. No.: 783,791

[22] Filed: Apr. 1, 1977

[51] Int. Cl.[2] ..... G07F 9/06

[52] U.S. Cl. ..... 194/1 B

[58] Field of Search ..... 194/92, 93, 1 E, 1 G, 194/DIG. 2, 97, 1 B, 55–60; 232/57, 58, 57.5, 59, 60

[56] References Cited

U.S. PATENT DOCUMENTS

| | | | |
|---|---|---|---|
| 1,010,741 | 12/1911 | Dreher | 194/1 E |
| 3,978,960 | 9/1976 | Mellinger et al. | 194/55 |

*Primary Examiner*—Stanley H. Tollberg

*Attorney, Agent, or Firm*—Weiser, Stapler & Spivak

[57] ABSTRACT

A tamperproof coin box closure for use in the coin mechanism housing of coin operated washers and dryers to receive coins from a vertical coin slide. The closure comprises in one embodiment a horizontal plate and a slotted coin receiving member fixedly associated therewith. In a second embodiment, the coin receiving member is pivotally associated. The coin receiving member of both embodiments has slots of close tolerance to the size of coins and is intended for vertical passage of the coins therethrough upon release from a coin slide.

6 Claims, 4 Drawing Figures

TAMPERPROOF COIN BOX CLOSURE

BACKGROUND OF THE INVENTION

The present invention relates generally to the field of closures for coin collection boxes used in various types of coin operated washers and dryers, and more particularly to a coin box closure having a slotted coin receiving member for use with coin slides which accept vertically positioned coins.

Considerable efforts have been made by prior workers in the field to provide tamperproof or burglarproof coin boxes for use in association with coin operated machines. These coin boxes have generally employed funnels or pivoting flippers designed to prevent easy removal of coins from the coin boxes once they have passed therethrough and into the interior of the coin box. However, these security devices do not satisfy the increasing need for protective measures, inasmuch as access to the coin box cannot be effectively prevented. Also, the need both for additional security and for accommodating additional coins has resulted in the emergence of newly designed coin slide devices, particularly vertical coin slides. The prior art coin boxes are not particularly adapted or designed for use in combination with coin slide assemblies designed to accommodate a plurality of coins in vertical orientation.

Some of the prior art coin boxes have been developed which incorporate a funnel shaped acceptance mechanism which is positioned at the top of the coin box in alignment to receive coins from the coin slide. In such devices, coins drop through the funnel upright, flat or otherwise orientated without difficulty. To achieve this, the opening at the base of the funnel is required to be of relatively large size. While this type of funnel has been widely used in the industry, but can not provide an acceptable degree of security since coins can be removed through the large opening in the funnel. Additionally, this design of funnel opening is clearly intended for use in conventional horizontal coin slide devices and is not particularly adapted for use with vertical coin slides.

In a variation of the funnel apparatus, the chute has been designed to converge to an opening of lesser diameter so that coins that are released either horizontally or vertically are aligned in a relatively vertical position by sliding along the inclined walls of the funnel. Again in this device, all of the coins used in operation of the coin slide are dropped into a single opening opening which is the mouth of the funnel. From this broad opening, the coins are directed into a single slit-like opening that is designed to receive all coins. This type of funnel has a smaller opening at the base thereof, but still does not provide the maximum security or selectivity required.

In another type of device, prior workers have provided a pivoting flipper which comprises a pivotal top or flipper that is affixed to the upper opening of the coin box. The flipper is pivotally mounted at each end, to the top of the side walls of the coin box in a manner to be pivoted by the weight of the coins released from an associated coin slide. The weight of the coin dropping against the upper surface of the pivoting flipper, rotates the flipper and thus allows the coins to pass into the box interior. There remains in this device the potential for unauthorized coin removal which can be accomplished by propping the pivoting flipper into a relatively vertical position to thereby allow unencumbered entry into the interior. Additionally, complete removal of the flipper can be rather easily accomplished by applying sufficient downward pressure to disassociate the flipper pivots and thus expose the coin box contents. There remains in the field of coin box closures the need for a tamperproof closure, particularly one adapted for use with coin slides of the vertical coin type.

SUMMARY OF THE INVENTION

The tamperproof coin box closure of the present invention comprises in one embodiment a protected opening having a slotted coin receiving plate fixedly associated above the coin box. The coin receiving plate is machined, punched or otherwise treated to provide a plurality of rectangular coin accepting slots therethrough. The coin receiving plate may be secured to or may be of unitary construction with the usual horizontal separator between the coin slide and the coin box. Also, the closure may be of unitary construction with the coin box or may be fixedly secured thereto. The slots of the coin receiving plate member are sized to close tolerance of coins intended for passage therethrough, thus permitting selective entry of coins therethrough. The slots may be of uniform size or each may be independently sized according to the selected combinations of of coins required for the particular machine in which the coin box is used. Further, the slots may be arranged in any preferred design of positional relation to the coin slide for individual passage of coins as released from the coin slide, thus providing additional selectively and resultant security.

It is particularly noteworthy that the coins are individually passed through individual slots and do not require contact of the coins with any portion of the closure for passage therethrough.

In another embodiment, a pivoting flipper or pivoting closure is mounted in a housing in the horizontal separator in vertical registry below the coin drop area of the usual coin slide. The flipper is machined or otherwise treated to provide a plurality of transversely spaced coin receiving slots. The flipper is positioned to receive coins either in horizontal orientation from a horizontal coin slide or in vertical orientation from a vertical coin slide. The slots are sized to close tolerances to receive coins in vertical orientation with just sufficient clearance to accept the coins.

The tamperproof coin box closure may be fabricated of any rigid material suitable for use in coin vending machines or the like. Particularly suitable is a strong material such as steel or other similar metal. In a preferred embodiment, a horizontal separator partially enclosed the upper boundary of the interior space within which the coin box is slidably positioned. An opening is defined within the separator and the coin receiving plate of flipper is positioned to protect the opening.

The coin receiving plate or flipper may be positioned in a housing which may extend upwardly from the horizontal separator or may be in planar alignment therewith. The slots formed in the plate or flipper surface have dimensions to receive vertically oriented coins at close tolerance. The coin receiving plates or flipper are preferably fabricated to discourage removal from the exterior.

It is therefore an object of the present invention to provide an improved tamperproof coin box closure of the type set forth.

It is another object of the present invention to provide a tamperproof coin box closure which is particularly adapted for use in association with vertically accepting coin slides.

It is another object of the present invention to provide a tamperproof coin box closure which may be easily and rapidly implanted in the coin mechanism housing of a coin operated machine.

It is another object of the present invention to provide a tamperproof coin box closure having vertical coin accepting slots of dimensions chosen for selective passage of predetermined combination of coins therethrough.

It is another object of the present invention to provide a tamperproof coin box closure having coin accepting slots of dimensions which permit only vertical entry of coins.

It is another object of the present invention to provide a tamperproof coin box closure including means for accepting coins both in vertical orientation and in flat orientation.

It is another object of the present invention to provide a tamperproof coin vault closure that is inexpensive in manufacture, simple in operation and reliable when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENTS OF THE INVENTION

Figure 1:
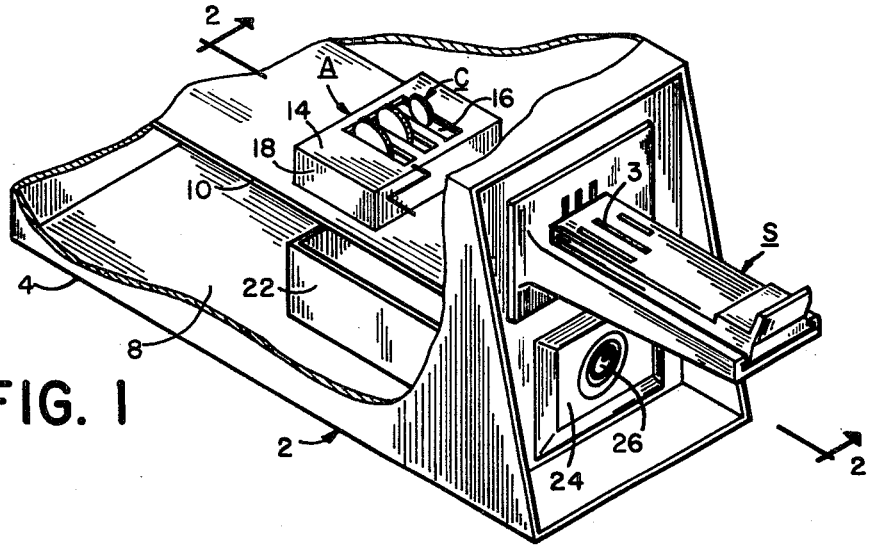
FIG. 1 is an isometric view, partially broken away, of a preferred embodiment of a tamperproof coin box closure positioned in the coin mechanism housing of a coin operated machine.

Although specific terms are used in the following description for the sake of clarity, these terms are intended to refer only to the particular structure of the invention selected for illustration in the drawings, and are not intended to define or limit the scope of the invention.

As shown in the drawings, the tamperproof coin box closure, generally designated A, comprises a horizontal separator 10 and a slotted coin receiving plate 14 designed for fixed association therewith. The horizontal separator 10 and coin receiving plate 14, together with the base 4 and sidewalls 6 of the machine housing 2, define an interior space 8 which cannot be opened from above and which is suitable for removable storage of a conventional coin box 22. The closure A is fabricated from a firm, unyielding material such as sheet steel of sufficient thickness to resist an authorized attempted entry.

Figure 2:
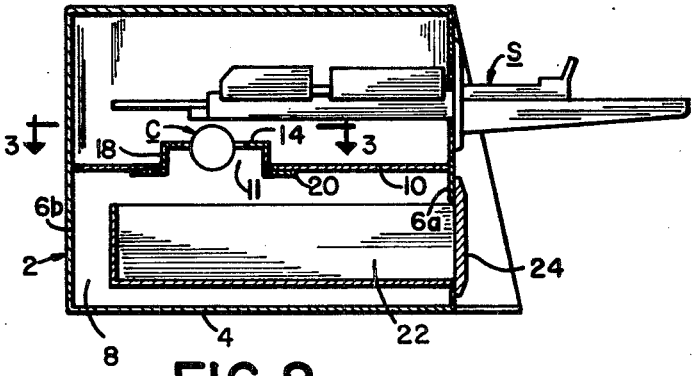
FIG. 2 is a cross-sectional view taken along Line 2—2 of FIG. 1, looking in the direction of the arrows.
Figure 3:
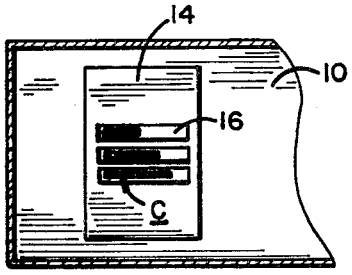
FIG. 3 is a top plan view looking from Line 3—3 of FIG. 2, in the direction of the arrows.

Referring now to FIGS. 1, 2 and 3, the tamperproof coin box closure A is illustrated in position above a coin box or drawer 22, which extends into the interior space 8 below the coin slide assembly S. Thus, coins released from the coin slide S are required to pass through the coin receiving plate 14 of closure A before passage into the interior space 8 where they fall by gravity into the drawer 22. It will be noted the the slide S includes a plurality of slots 3 which are designed to receive and retain a plurality of coins in transversely spaced, vertical relationship. It will be appreciated that only three slots are actually illustrated, but that four, five or six or more slots could be employed in the slide S and still come within the scope of this invention.

As shown, the horizontal separator 10 partially encloses the upper boundary of the interior space 8 and is fixedly secured to the side walls 6 of the coin housing 2. The separator 10 is secured to the housing walls 6 in a manner to prevent separator removal from the exterior.

The horizontal separator 10 may also be separate from the coin receiving plate 14 which is secured thereto. The plate 14 is provided with an opening 11 through which the coins C can fall into the coin box 22. The opening 11 may be generally rectangular shape and of dimensions to receive all coins as they drop through the coin receiving plate 14. In a preferred embodiment, the coin receiving plate 14 is secured to and above the separator 10 by a peripheral housing 18 which may be spot welded or otherwise secured in position. The separator 10, coin receiving plate 14 and the housing 18 are in a manner to discourage tampering and to prevent removal from the exterior. Flanges 20 may be employed to form a shoulder which acts as a horizontal locking surface when abutting the lower surface of the horizontal separator 10 to prevent removal of the housing 18 and coin receiving plate 14 from above.

The coin receiving plate 14 includes a plurality of coin receiving slots 16 which are transversely spaced to register below the coin slide slots 3 when the coin slide is pushed to its inner, operating position (FIG. 2). The rectangular shape of each of the coin accepting slots 16 is designed to selectively accommodate passage of specific coin combinations. That is, that the slots are of dimensions which permit selective entry of coins of predetermined diameter.

As is best seen in FIG. 2, the horizontal separator 10 extends the full distance between the front wall **6*a* and back wall 6*b* of housing 2 and across the width of the housing 2. The only normal access to the interior space 8 is through removal coin drawer 22 after unlocking the lock 26 which is normally retained in the coin drawer front plate 24. As the coin slots 16** are dimensioned to close tolerance with the coins intended for passage therethrough, the openings are too small for removal of coins upwardly therethrough by mechanical insertions or manipulation.

The position of the closure A is illustrated to generally bisect the housing 2 into the upper and lower portions. Sufficient space is left in the upper portion for operation of a coin slide assembly S which is fitted therein in well known manner. The slots 16 of the coin receiving plate 14 are positioned beneath the portion of the coin slide assembly S from which the coins C are released and the slots 16 in the plate 14 register below the slots 3 in the coin slide S to thereby receive coins C as they fall from the coin slide after the coin slide in inwardly urged for machine operation.

FIG. 3 illustrates the use of slots 16 of uniform size with a variety of coin denominations. This embodiment enhances versatility of the coin receiving plate 14 in the variety of coin operated machines with which it can be associated.

Referring now to FIG, 4, there is illustrated a modified coin receiving opening 28 wherein a peripheral housing 18*a* is secured to the horizontal separator 10 in position to receive coins from a coin slide S. A generally V-shaped flapper 30 is pivotally mounted within the housing 18 and comprises generally a pair of angularly intersecting sides 32, 34 which intersect at the flapper apex 36. A pair of transverse pivots 38, 40 hingedly interconnect the flapper apex 36 to the housing 18*a* to thereby allow the flapper sides 32, 34 to freely pivot relative to the housing 18*a*. Accordingly, should coins C be presented in flat or horizontal orientation (not illustrated) to the opening 28, the flapper can act to receive and discharge such coins into the cash box 22 in a protected manner.

Figure 4:
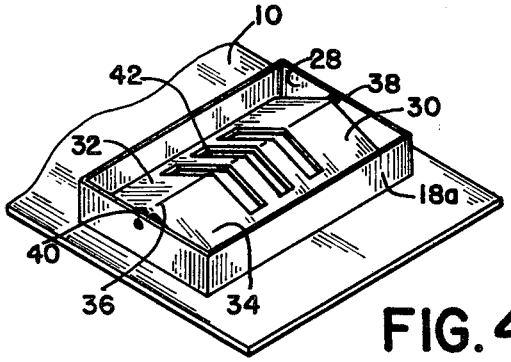
FIG. 4 is an isometric view of a modified tamperproof coin box closure.

Still referring to FIG. 4, the flapper 30 is illustrated comprising a plurality of transversely spaced, coin receiving slots 42 for receipt of vertically oriented coins therethrough. The slots may all be of the same sizes as indicated or may be of different sizes to more closely approximate the sizes of different coins which are to be received therethrough. As in the embodiment illustrated in FIGS. 2 and 3, the slots 42 should align under the coin slide slots 3 when the slide S is pushed to its machine operating position. The slots 42 may be equally machined in the flapper side 30, 32 as illustrated, or may be longitudinally offset to be positioned either entirely or substantially in only one of the flapper sides 30, 32. In this manner, the coin receiving opening can be protected from unauthorized access and can be equipped with a single device that is capable of accepting coins that are presented both in vertical orientation and in horizontal orientation.

Although the invention has been described with a certain degree of particularly, it is understood that the present disclosure has been made only by way of example and that numerous changes in the details of construction and the combination and arrangement of parts may be resorted to without departing from the scope of the invention.

What is claimed is:

1. A tamperproof coin box closure to receive coins released by a coin slide comprising a separator having an opening therein in a position to receive coins from the coin slide; and a coin receiving member being pivotally secured within the opening and being adapted to permit the unrestricted passage of coins into the interior of the said coin box closure, said member being provided with a plurality of coin accepting slots, said slots being of sufficient size to receive coins intended for passsage therethrough as the coins are released from the coin slide.

2. The tamperproof coin box closure of claim 1 wherein the coin receiving member comprises a flipper having two sides, the said sides angularly intersecting.

3. The tamperproof coin box closure of claim 2 wherein the sides angularly intersect to form a transverse ridge and wherein the flipper is pivotally secured at the ridge.

4. The tamperproof coin box closure of claim 2 wherein the slots are transversely spaced relative to the ridge.

5. The tamperproof coin box closure of claim 4 wherein at least one of said slots extends through the ridge.

6. The tamperproof coin box closure of claim 4 wherein all of said slots extend through the ridge.

* * * * *